US007413475B2

(12) United States Patent
Matsuo et al.

(10) Patent No.: US 7,413,475 B2
(45) Date of Patent: Aug. 19, 2008

(54) ELECTRICAL CONNECTOR HAVING GROUND PLANES

(75) Inventors: Tsutomu Matsuo, Tokyo (JP); Tadashi Ohshida, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/520,617

(22) Filed: Sep. 14, 2006

(65) Prior Publication Data

US 2007/0066140 A1 Mar. 22, 2007

(30) Foreign Application Priority Data

Sep. 22, 2005 (JP) ..... 2005-275809

(51) Int. Cl.
*H01R 13/648* (2006.01)

(52) U.S. Cl. ..... 439/608

(58) Field of Classification Search ..... 439/608, 439/701, 719, 79

See application file for complete search history.

(56) References Cited

U.S. PATENT DOCUMENTS 6,743,057 B2 * 6/2004 Davis et al. ..... 439/701
7,278,886 B2 * 10/2007 Cohen et al. ..... 439/608
2002/0168898 A1 * 11/2002 Billman et al. ..... 439/608

FOREIGN PATENT DOCUMENTS

JP 2000-067955 3/2000

OTHER PUBLICATIONS

European Search Report, Apr. 27, 2007.

* cited by examiner

*Primary Examiner*—Alexander Gilman
(74) *Attorney, Agent, or Firm*—Kubotera & Associates, LLC

(57) ABSTRACT

An electrical connector (10) has ground planes (13). Each ground plane (13) crosses counter ground planes (36) of the counter connector (30) so as to make a lattice structure when the counter connector (30) is fitted to the connector (10). The contact section (12C) of a signal terminal (12) of the connector (10) has a plane surface perpendicular to the surface of the corresponding counter contact section (34A) of the counter signal terminal (34), and formed at a flexible elastic arm (12B) in the plane surface. The ground plane (13) has pressure-welding sections (18B) and (20B), which individually elastically contact with the facing inner surfaces of each slit, at a portion to be put into each slit of the counter ground plane (36).

12 Claims, 5 Drawing Sheets

ELECTRICAL CONNECTOR HAVING GROUND PLANES

BACKGROUND OF THE INVENTION

The present invention relates to an electrical connector having ground planes. For example, Japan Patent Application Publication 2000-67955 discloses an electrical connector of this type. According to this Patent Reference, the connectors which are fitted and connected to each other have a plurality of ground planes that form a lattice structure by crossing each other, and contacting sections of signal terminals are located within the spaces made by the lattice structure. A slit that opens in the fitting direction is formed in a specified pitch on each of the plurality of ground planes of one connector, and the ground planes of the other connector arranged in a direction perpendicular to the ground planes are designed to put into the slits. An elastic section is formed by a cutout groove on the other connector, and elastically connects with the inner surface of the slit entering in the slit. Accordingly, the ground planes of the two connectors forms lattice-like structure and ensure the contact between the two connectors.

However, the connector of the Patent Reference has a problem of requiring large force to insert/remove the connector. According to the Patent Reference, the elastic section of the ground plane of the other connector that enters the slit formed on the connector has only one slit formed for on slit. Therefore, the elastic pressure to contact with one slit has to be ensured by one elastic section. This means elastic displacement has to be made by one elastic section for the slit width. In addition, the elastic pressure has to be large. On the other hand, if the slit width is made smaller, enough elastic displacement can not be securely made, which may cause poor connection at other slits due to different dimension among slits. Since there are many slits like this in the whole connector, the force to insert/remove the slit has to be large, and therefore unreasonably excessive force is applied for inserting/removing, which is not good for the connectors.

SUMMARY OF THE INVENTION

Accordingly, it is an object of the invention to provide an electrical connector having a ground plane that can be smoothly inserted/removed, while ensuring the elastic displacement of the elastic piece for contacting between the ground planes.

According to the invention, there is provided an electrical connector, in which a plurality of ground planes are arranged such that each surface is parallel to the other, and the contact sections of the signal terminals are arranged between the ground planes. In this electrical connector, at the time of fitting to the counter connector, the ground plane cross the counter ground plane so as to form a lattice-like structure, and the contact sections of the signal terminals are located in the spaces made by the lattice-like structure.

In the electrical connector of the invention described above, the contact sections of the signal terminals have a perpendicular surface to the corresponding contact section surface, and formed on the flexible elastic arm in the plate surface. Also, it has a plurality of different elastic pieces on which a pressure-welding section that separately contacts with each facing inner surface of each slit is formed.

In the connector of the present invention having such constitution, a plurality of the elastic sections of the ground plate of this invention individually contact with the facing inner surface of each slit of the counter ground plane, and the slit width is managed by the sum of the displacement of the plurality of elastic pieces. Therefore a connector requiring small inserting/removing force can be provided.

In this invention, for the signal terminal, the elastic arm has generally S-shape, and its free end forms a contact section. The ground plane forms an elastic arm and its adjacent wall by the cutout grooves. When it is viewed in a direction perpendicular to the ground plane surface, it is preferred that the elastic arm continuously located within the region of the elastic section and the wall without crossing the cutout groove in the whole length. By forming the ground plane in this way, since the feedback current path at the ground plane corresponds to the current path of the signal terminal, the distance between the paths is minimized, so that the propagation energy loss at the transmission circuit can be minimized.

In this invention, for example, two elastic sections can be provided for one slit of the counter ground plane, and the pressure-welding section of one elastic piece can be arranged so as to displace in a direction opposite to each other in the plate thickness direction of the ground plane. In this case, more specifically, the base sections of the two elastic sections are located in opposite to each other with regard to the counter ground plane in the thickness direction of the counter ground plane, and the pressure-welding sections of those elastic sections can be formed so as to be within an area that includes the positions for slits of the counter ground plane in the above-described thickness direction, and also can be displaced with regard to each other in the connector fitting direction.

As described above, in this invention, a plurality of elastic sections are formed on the ground plane of the connector to fit to the counter connector for each slit of the counter ground plane, and these elastic pieces are separately elastically contacted by pressure with the facing inner surface of the slit. Therefore, even if the displacement of one elastic piece is small, a certain displacement can be ensured by the plurality of elastic pieces. In addition, the elastic pressure can be made small by controlling. As a result, while achieving satisfactory contact between the ground planes, reducing the force required to insert/remove the connector, smooth inserting/removing is enabled.

DESCRIPTION OF THE PREFERRED EMBODIMENTS

An embodiment of the invention will now be described with reference to the accompanying drawings, FIGS. 1-5. In the connector 10 of this embodiment illustrated in FIG. 1, signal terminals 12 and ground planes 13 are supported by a housing 11 made of an electrical insulating material. In the figure, the signal terminals 12 and the ground planes 13 respectively have a surface that is generally parallel to the XZ-plane in the three-dimensional coordinate XYZ system, and are arranged alternately at regular intervals in the Y-direction.

Figure 1:
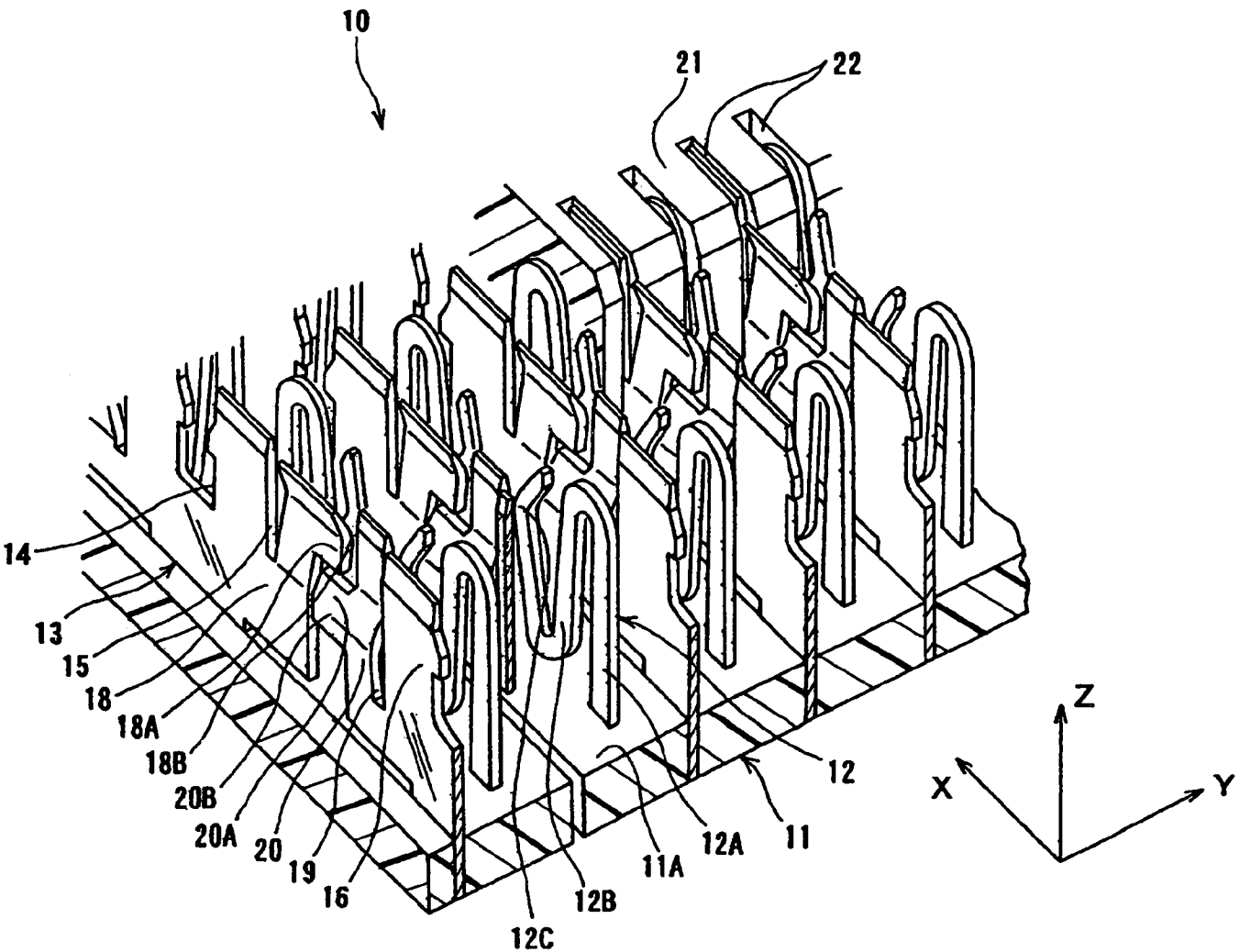
FIG. 1 is a partial cut-away perspective view of major portion of the connector according to an embodiment of this invention.
Figure 3:
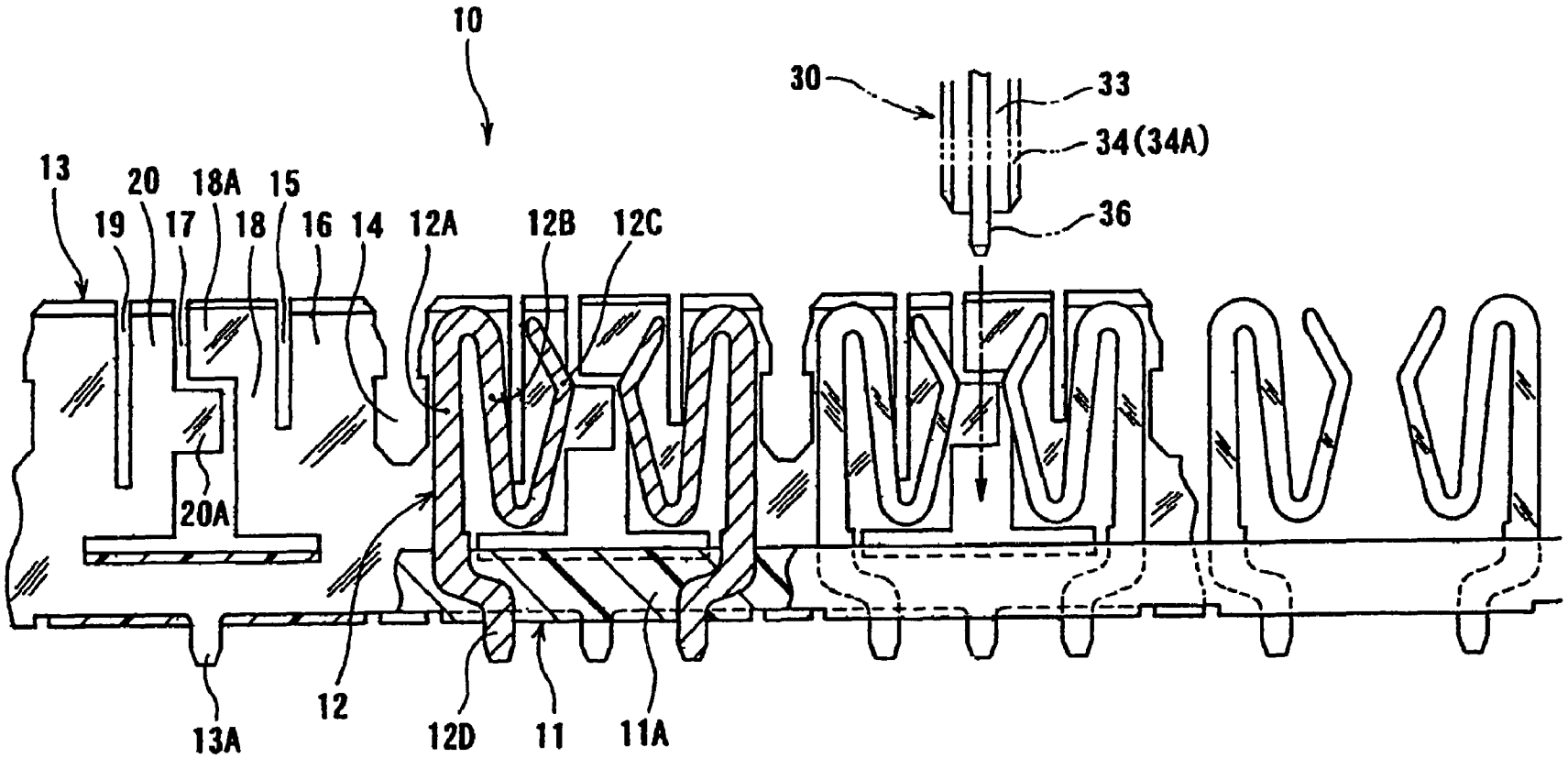
FIG. 3 is a side view showing the arrangement of the signal terminals and the ground plane of the connector of FIG. 1.

As shown in FIGS. 1 and 3, a plurality of signal terminals 12 on one XZ-plane is formed by forming the outer shape while keeping the plane surface of a metallic sheet, and the plane surface is in the XZ-plane. Each signal terminal 12 has a generally S-shaped elastic arm 12B, which extends from a upright section 12A that protrudes upward above the portion held in the bottom wall 11A of the housing, and has a contact section 12C, which is an angled section formed at the free end of the elastic arm 12B. In addition, a lower portion than the portion held in the housing 11 forms a contact section 12D (see FIG. 3), protruding downward from the bottom wall 11A of the housing 11. The signal terminals 12 formed in this way are symmetrically arranged in pairs such that the two adjacent elastic arms 12B face each other.

A plurality of pairs of signal terminals 12 is arranged in the X-direction, and such plurality of pairs of signal terminals is provided in a plurality of rows at regular intervals in the Y-direction. Between each adjacent rows of the signal terminals provided in the Y-direction, a ground plane 13 is supported by the bottom wall 11A of the housing 11. As also understood from FIG. 3, the ground plane 13 is formed by a metallic sheet so as to be continuous in the XZ-plane.

When it is viewed in the Y-direction, one ground plane 13 faces the plurality of signal terminals 12. As illustrated in FIG. 3, each ground plane 13 is continuous in the bottom wall section 11A of the housing 11, but has differently shaped sections formed by a plurality of cutout grooves that are open upward above the upper surface of the bottom wall 11A.

A wall section 16 is formed between a wide groove 14 and a narrow groove 15, which extend from the upper edge of the ground plane 13 to the middle portion. A first elastic section 18 is formed between the narrow groove 15 and its adjacent non-straight (generally crank-shaped) groove 17 which extends to the bottom wall 11A, and a second elastic section 20 is formed between a deep groove 19 that extends further downward than the narrow groove 15 and the non-straight groove 17. The both left and right wall sections 16 of the wide groove 14, and the first elastic section 18 and the second elastic section 20 are respectively formed symmetrically with regard to the wide groove 14. Since the wide groove 14 that forms one side edge of the wall section 16 does not extend downward so deep, it has relatively large rigidity. On the other hand, since the non-straight groove 17 is formed deep, the first elastic section 18 and the second elastic section 20 have flexibility and elasticity in the thickness direction of the ground plane 13.

While the wall section 16 has a relatively simple tongue shape, the first elastic section 18 and the second elastic section 20 have complicated shape since the non-straight groove 17 formed between them is angled to have a generally crank-shape. While the first elastic section 18 has a first projecting section 18A, the upper edge of which projects toward the non-straight groove 17, the second elastic section 20 has a second projecting section 20A, which projects toward the non-straight groove 17 below the first projecting section 18A of the first elastic section 18.

As shown in FIG. 3, the first projecting section 18A and the second projecting section 20A have an area where the sections overlap in the lateral direction (the X-direction in FIG. 1). As shown in FIG. 1, the first projecting section 18A and the second projecting section 20A are angled like a dogleg in the direction opposite each other in the thickness direction. Those angled protrusions form pressure-welding sections 18A and 20B that contact with the slit inner surfaces formed on the counter ground plane. In other words, those two pressure-welding sections 18B and 20B are displaced in the direction opposite each other in the thickness direction of the ground plane 13, and positioned on/under the other so as to overlap in the above-described lateral direction.

As seen in FIG. 3, when it is viewed in the direction perpendicular to the plate surfaces of the ground plane 13 and the signal terminals 12, i.e. in a direction perpendicular to the paper surface in FIG. 3 (the Y-direction in FIG. 1), each signal terminal 12 is completely within the region of the wall section 16 and the first elastic section 18 or within the region of the wall section 16 and the second elastic section 20 of the ground plane 13. The cutout grooves of the ground plane 13, i.e. the wide grooves 14, the narrow grooves 15, and the deep grooves 19, do not cross the signal terminal 12. Each signal terminal 12 faces the ground plane 13 throughout its length (but excluding the portion protruding downward from the bottom wall 11A of the housing 11).

In addition, each ground plane 13 has contact sections 13A that protrude downward from the bottom wall 11A of the housing. The connector 10 having the ground planes 13 and the signals terminals 12 as described above has a fitting section 21 that protrudes upward from the bottom wall 11A of the housing 11. This fitting section 21 extends in the Y-direction in FIG. 1, and has slits 22 at regular intervals in the Y-direction. A portion of each elastic arm 12B other than the free end that has the contact section 12C of the signal terminal 12 on its end and the wall sections 16 of the ground plane 13 are placed into the corresponding slits 22.

Figure 2:
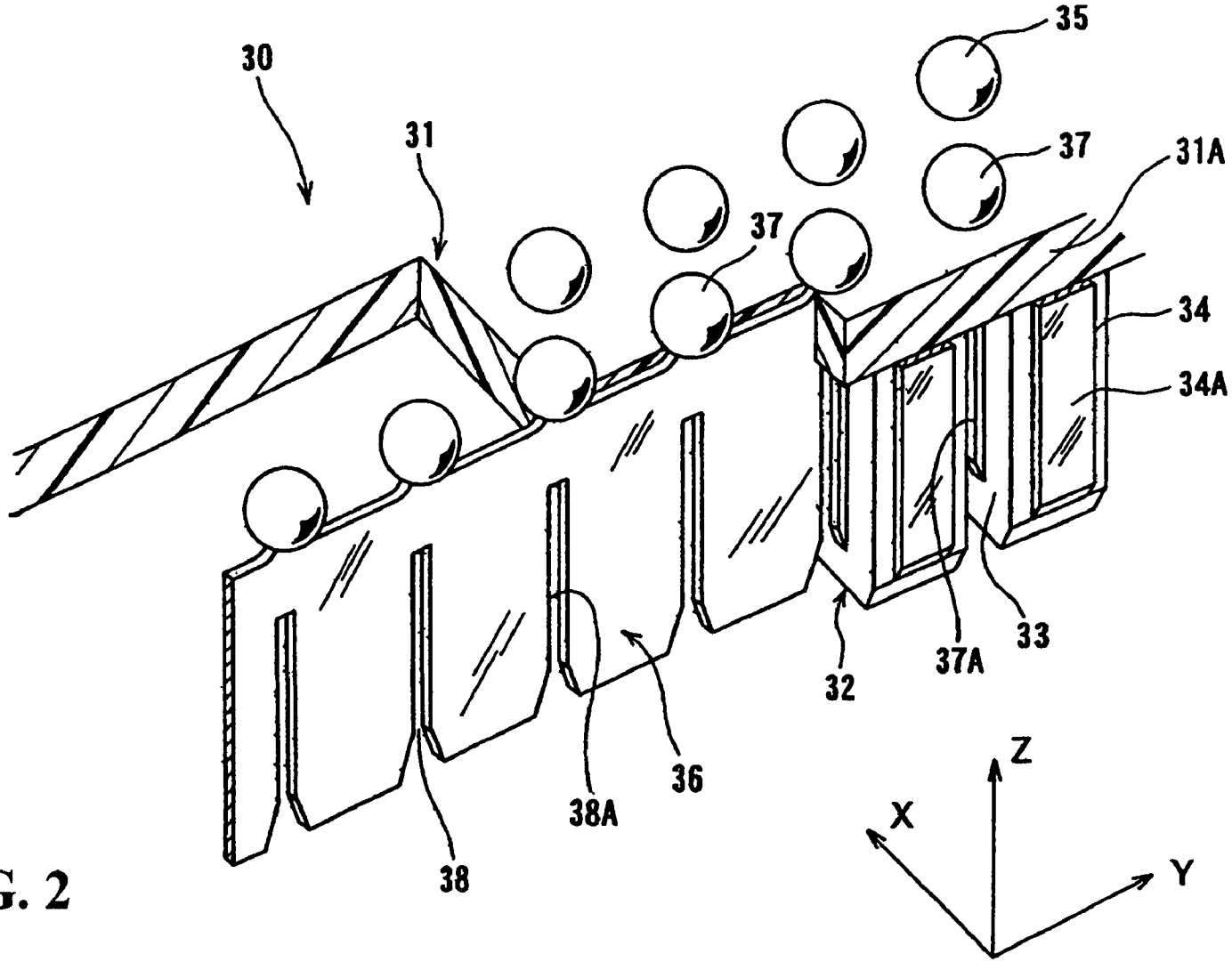
FIG. 2 is a partial cut-away perspective view of the major portion of the counter connector of the connector of FIG. 1.

As seen in FIG. 2, in the counter connector 30 to fit and connect to the connector 10 of this embodiment, the counter housing 31 has counter fitting sections 32 that protrudes downward from the upper wall 31A of the counter housing 31. These counter fitting sections 32 are fitted in between the fitting sections 21, being put into the space formed by the fitting sections 21 of the connector 10. The counter fitting sections 32 have receiving grooves 33 at specified positions in the Y-direction so as to receive the first elastic section 18 and the second elastic section 20 of the ground plane 13 of the connector 10. Each counter signal terminal 34 of the counter connector 30 has flat counter contact sections 34A that are tightly attached to the YZ-plane of the counter fitting section 32. Solder ball 35 is provided at each connecting section that protrudes from the upper wall 31A of the counter housing 31.

The counter ground plane 36 extends in the Y-direction, the plate surface being in the YZ-plane. Slits to press therein the first elastic section 18 and the second elastic section 20 of the ground plane 13 are formed at specified positions in the Y-direction, being open downward. The counter ground plane 36 is held in the counter fitting sections 32 of the counter housing 31 by one-piece molding. The facing inner edges 38A of each slit 38 protrude from the side surfaces of the receiving groove 33 of the counter housing 31. Each counter ground plane 36 has connecting sections that protrude from the upper wall section 31A of the counter housing 31. A solder ball 37 is provided on each connecting section.

The two connectors, the connector 10 and the counter connector 30, described above are fitted and connected to each other as described below.

First, the two connectors, the connector 10 and the counter connector 30, are respectively connected with solder to an object to connect, such as a circuit board, by connecting the contact section of each signal terminal and the connecting sections of the ground planes to corresponding sections of the object to connect.

Then, the two connectors, the connector 10 and the counter connector 30, are fitted to each other. This fitting is made by putting the fitting unit 21 of the connector 10 and the counter fitting sections 32 of the counter connector 30 into the corresponding recessed sections.

Once they are fitted each other, the ground plane 13 of the connector 10 and the counter ground plane 36 of the counter connector 30 cross each other and form a lattice-like structure On the other hand, the signal terminals 12 and the counter signal terminals 34 are connected by contact within each generally rectangular space made in the lattice structure. (See the portion of the double dashed line in FIG. 3 and FIG. 4).

Figure 4:
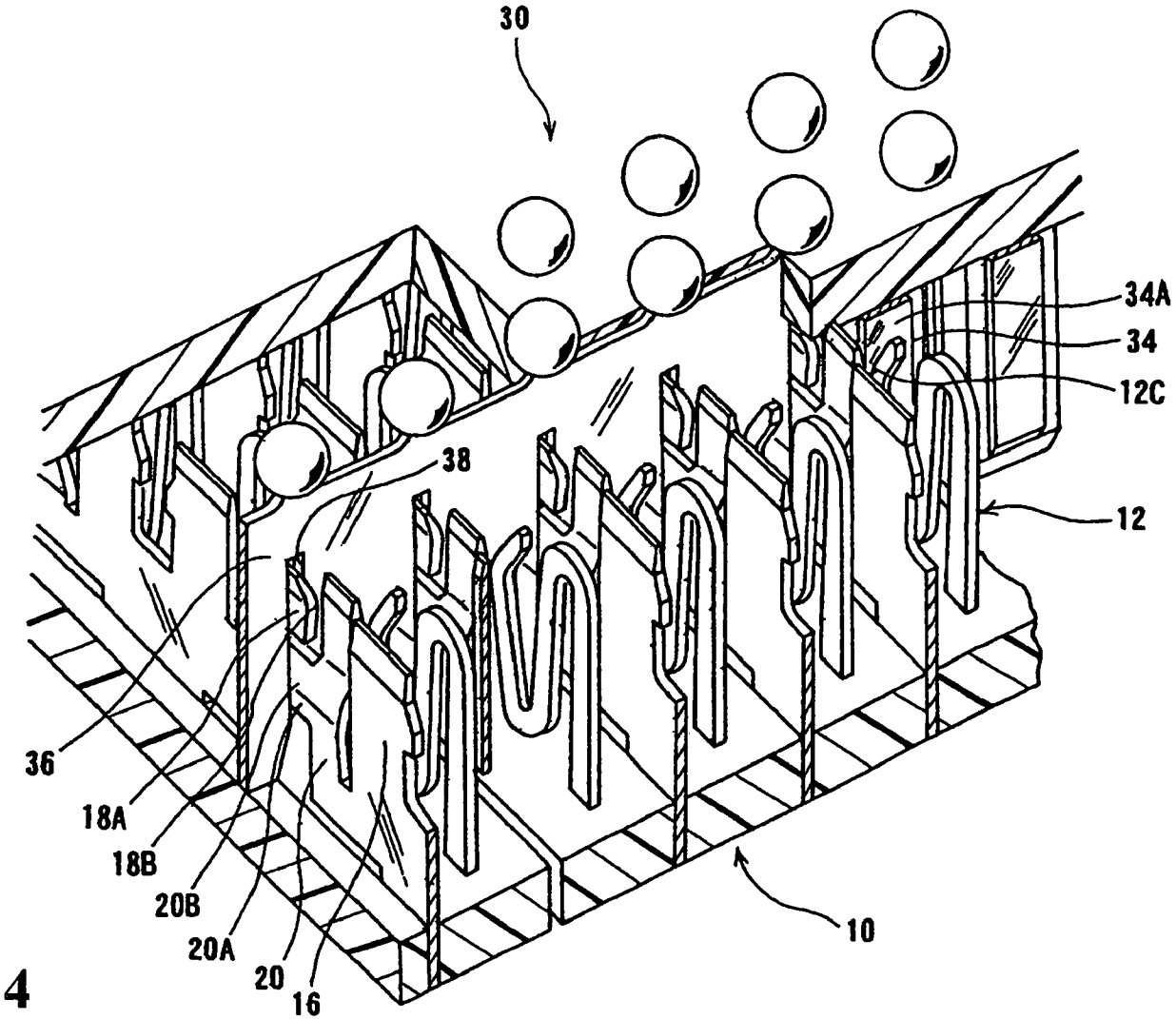
FIG. 4 is a partial cut-away perspective view of major portion of the connectors of FIGS. 1 and 2 when fitted.

As understood from FIGS. 3 and 4, the first elastic sections 18 and the second elastic sections 20 of each ground plane are put into the slits 38 of the counter ground plane 36, and the pressure-welding section 18B of each first projecting section 18A and the pressure-welding section 20B of each second projecting section 20A elastically contact by pressure with the surfaces of the two facing inner edges 38A. In other words, those two pressure-welding sections 18B and 20B separately elastically press the respective facing surface of the facing inner edges 38. Therefore, the ground plane 13 and the counter ground plane 36 can be contacted and connected to each other just by elastically displacing the welding sections 18B and 20B for the half distance of the groove width of the slit 38.

On the other hand, the contact section 12C of each signal terminal 12 of the connector 10 contacts with the contact section 34 of each signal terminal 34 of the counter connector 30, such that the contacting plate surfaces of the contact section 12C and the counter contact section 34 are perpendicular to each other. In the above-described signal terminals 12, each upright section 12A and elastic arm 12B are facing the area of the wall section 16 of the ground plane 13 and the first projecting section 18A or the area of the wall section 16 and the second projecting section 20A as described above, and the signal current path does not cross the cutout grooves of the ground plane 13 and continuously faces the ground plane 13. Therefore, the signal current path maintains the minimum distance from the ground plane 13, and therefore, the propagation energy loss in the transmission circuit is minimized.

Figure 5:
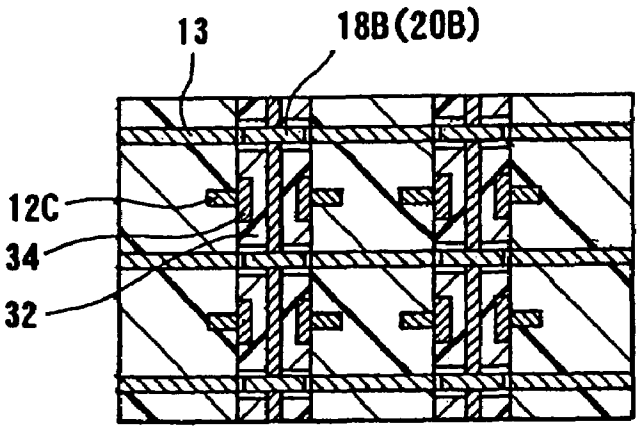
FIGS. 5(A) and 5(B) are cross-sectional schematic views showing the fitting of the connectors of FIGS. 1 and 2 before and after the fitting, respectively.
Figure 5:
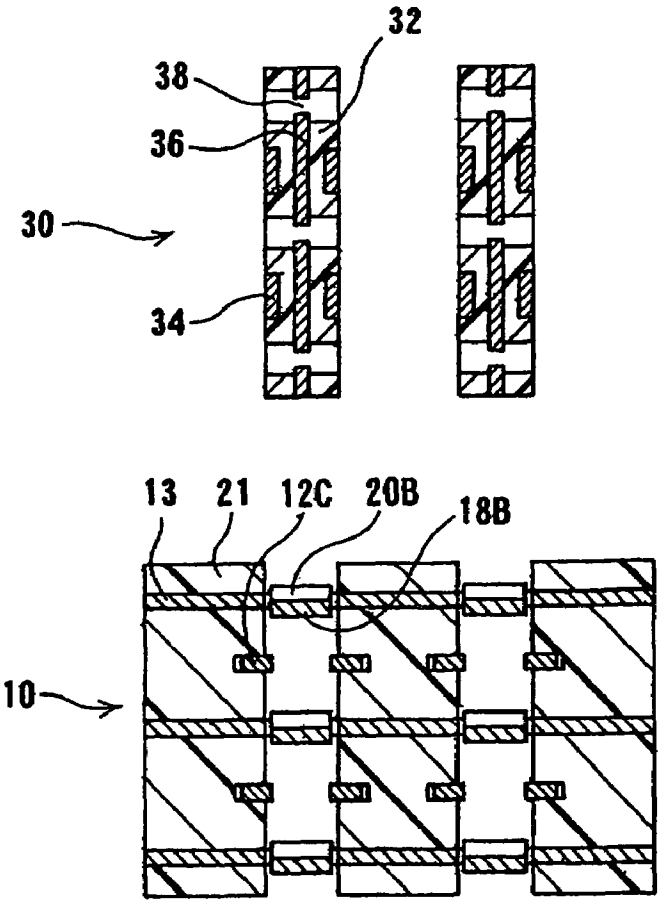

As described above, the connectors 10 and the counter connecter 30 which are fitted to each other, as understood from the cross-sectional schematic drawing, FIG. 5, the contact section 12C of each signal terminal and the counter contact section 34A of each counter signal terminal are in generally quadrilateral spaces of the lattice-like structure formed by the ground plane 13 and the counter ground plane 36, and shielded by the ground plane 13 and the counter ground plane 36. Here, FIG. 5(A) shows the connectors before and after the fitting.

The invention claimed is:

1. An electrical connector to be connected to a mating connector, comprising:

a plurality of ground planes arranged in parallel with each other so that the ground planes are electrically isolated with each other, each of said ground planes including an elastic section for elastically contacting with a counter ground plane of the mating connector when the electrical connector is connected to the mating connector, each of said ground planes further including a cutout portion defining said elastic section; and a signal terminal having a contact section located between said ground planes, said signal terminal including a flexible elastic arm so that the contact section contacts with a corresponding contact section of the mating connector when the electrical connector is connected to the mating connector, said signal terminal having an S-shape having a free end, said contact section being formed at the free end, said elastic arm being located without crossing the cutout portion over a whole length thereof viewed in a direction perpendicular to the ground plane.

2. The electrical connector according to claim 1, wherein said signal terminal includes a plurality of signal terminal positions facing the ground plane.

3. The electrical connector according to claim 1, wherein said elastic section is arranged to deform elastically in a thickness direction of the ground plane.

4. The electrical connector according to claim 1, wherein said signal terminal is arranged so that a space of the S-shape is situated to face the cutout portion.

5. The electrical connector according to claim 1, wherein said elastic section includes a first elastic section and a second elastic section, said first elastic section and said second elastic section being displaced in directions opposite each other.

6. The electrical connector according to claim 5, wherein said first and second elastic sections include base portions located in positions opposite each other with regard to said counter ground plane in a thickness direction of said counter ground plane.

7. The electrical connector according to claim 1, wherein said ground planes are arranged so that the ground planes form a lattice structure together with the counter ground planes of the mating connector when the electrical connector is connected to the mating connector.

8. The electrical connector according to claim 7, wherein said signal terminal is situated in one of spaces of the lattice structure when the electrical connector is fitted to the mating connector.

9. The electrical connector according to claim 1, further comprising a housing having a bottom wall, said ground planes and said signal terminal being attached to the bottom wall.

10. The electrical connector according to claim 9, wherein said cutout portion extends perpendicularly to the bottom wall.

11. The electrical connector according to claim 9, wherein said signal terminal includes an upright section extending perpendicularly to the bottom wall, said flexible elastic arm extending from the upright section.

12. The electrical connector according to claim 9, wherein said contact section is formed at an end portion of the S-shape opposite to the free end, said contact section being fixed to the housing.

* * * * *